US006824235B2

(12) United States Patent
Murata

(10) Patent No.: US 6,824,235 B2
(45) Date of Patent: Nov. 30, 2004

(54) RECORDING APPARATUS

(75) Inventor: Takayuki Murata, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/435,477

(22) Filed: May 12, 2003

(65) Prior Publication Data

US 2003/0210288 A1 Nov. 13, 2003

(30) Foreign Application Priority Data

May 13, 2002 (JP) ..... 2002-136948

(51) Int. Cl.[7] ..... B41J 29/38
(52) U.S. Cl. ..... 347/5; 347/10; 347/19
(58) Field of Search ..... 347/5, 16, 10, 347/19

(56) References Cited

U.S. PATENT DOCUMENTS 4,313,124 A 1/1982 Hara ..... 347/57
4,345,262 A 8/1982 Shirato et al. ..... 347/10
4,459,600 A 7/1984 Sato et al. ..... 347/47
4,463,359 A 7/1984 Ayata et al. ..... 347/56
4,558,333 A 12/1985 Sugitani et al. ..... 347/65
4,723,129 A 2/1988 Endo et al. ..... 347/56
4,740,796 A 4/1988 Endo et al. ..... 347/56
5,896,146 A 4/1999 Murata et al. ..... 347/42
6,226,100 B1 5/2001 Murata et al. ..... 358/1.8
2002/0048045 A1 4/2002 Umezawa et al. ..... 358/1.16
2002/0167561 A1 * 11/2002 Kasahara ..... 347/16

* cited by examiner

*Primary Examiner*—Hai Pham
*Assistant Examiner*—Lam Nguyen
(74) *Attorney, Agent, or Firm*—Fitzpatrick, Cella, Harper & Scinto

(57) ABSTRACT

In order to reduce emission noise, a recording apparatus uses a cycle controller to variably control a transmission cycle, when transmitting recording data to the recording head, and a head controller to control the recording head based on the controlled transmission cycle and the recording data. By varying the data transfer cycle of data to the recording head, the recording apparatus of the present invention makes it possible to suppress a rise in radiation noise peak levels due to overlapping of radiation noise spectra, which in turn weakens the strength of the electric field at certain cycles and makes it possible to reduce radiation noise levels.

4 Claims, 10 Drawing Sheets

RECORDING APPARATUS

FIELD OF THE INVENTION

The present invention relates to a recording apparatus for recording images onto a recording medium by the ejection of ink, and more particularly, to a recording apparatus having improved emission noise reduction.

BACKGROUND OF THE INVENTION

Conventionally, an ink jet recording apparatus that ejects ink onto a recording medium to form an image offers advantages of reduced noise, reduced running costs, compactness and good color imaging that make such an apparatus the device of choice in printers, copiers, facsimile machines and other, similar equipment.

Attempts to satisfy demands for higher-quality image output and faster recording speeds have led to increases in the number of ink-ejecting nozzles provided on the recording head and decreases in the recording cycles of the ink jet recording apparatus.

Further attempts to satisfy the above-mentioned demands involve increasing the resolution by increasing the image data transmission clock frequency (that is, shortening the transmission cycle).

The structure of the conventional ink jet recording apparatus is such that the clock signal is transmitted from the recording apparatus to the recording head, so the recording head, which scans the recording medium during recording, and the recording apparatus are connected to each other by a flexible cable or the like, with the clock signal, image data and so forth being sent to the recording head in the form of serial signals.

However, given the arrangement described above, the flexible cable that connects the recording head to the recording apparatus may be exposed to large electrical currents in the vicinity thereof that can generate noise in the transmission of signals via the flexible cable. Therefore, when transmitting high-frequency clock signals, the cable may sometimes act essentially as an antenna, generating noise, which in turn can cause devices in the vicinity of the recording apparatus to malfunction.

In addition, regulatory restrictions on the acceptable level of radiation emitted by electrical and electronic devices continue to become more stringent even as the speed with which the transfer of image data increases attendant upon increases in recording speeds.

Accordingly, it is critical to find ways to prevent ever-increasing levels of radiation generated inside devices such as ink jet recording apparatuses from leaking from such devices.

BRIEF SUMMARY OF THE INVENTION

Accordingly, the present invention has been conceived in light of the foregoing considerations, and has as its object to provide an improved recording apparatus in which the above-described problem of the conventional art is solved. More specifically, it is an object of the present invention to provide a recording apparatus with improved emission noise reduction.

The above-described object of the present invention is achieved by a recording apparatus which performs recording having a recording head, over a recording medium based on information transmitted by an external apparatus, the recording apparatus comprising:

a cycle control unit adapted to variably control a transmission cycle, when transmitting recording data to the recording head;

a head control unit adapted to control the recording head based on the controlled transmission cycle and the recording data.

Other objects, features, effects and advantages of the present invention will be apparent from the following description, taken in conjunction with the accompanying drawings, in which like reference characters designate the same or similar parts throughout the figures thereof.

BRIEF DESCRIPTION OF THE SEVERAL VIEWS OF THE DRAWINGS

The accompanying drawings, which are incorporated in and constitute a part of the specification, illustrate embodiments of the invention and, together with the description, serve to explain the principles of the invention, in which.

DETAILED DESCRIPTION OF THE PREFERRED EMBODIMENTS

Preferred embodiments of the present invention are described in detail in accordance with the accompanying drawings.

It should be noted that, in the following embodiments, the description assumes a printer is the recording apparatus, and moreover, that such a printer employs the ink jet recording method.

It should further be noted that, in the present specification, the term "recording" (hereinafter sometimes used interchangeably with the term "print") is used not only in the case of print, graphics and other meaningful information. Rather, the term is used in its broadest sense to include also images, patterns and the like on a recording medium, whether meaningful or not, whether directly readable by the human eye or not, and also specifically includes the processing of such medium as well.

Additionally, the term "recording medium" herein means not only the paper used in any typical recording apparatus but any material capable of retaining ink, including (but not limited to) cloth and other fabrics, plastic and film, metallic plates, glass, ceramics, wood, leather, and so forth.

Moreover, the term "ink" (hereinafter sometimes used interchangeably with the term "fluid"), like the term "recording" (or "print"), is also meant to be interpreted in the broadest sense to mean a fluid that forms an image, pattern or the like when applied to the surface of the recording medium as well as the fluid supplied in the processing of the recording medium or the processing of the ink.

Figure 1:
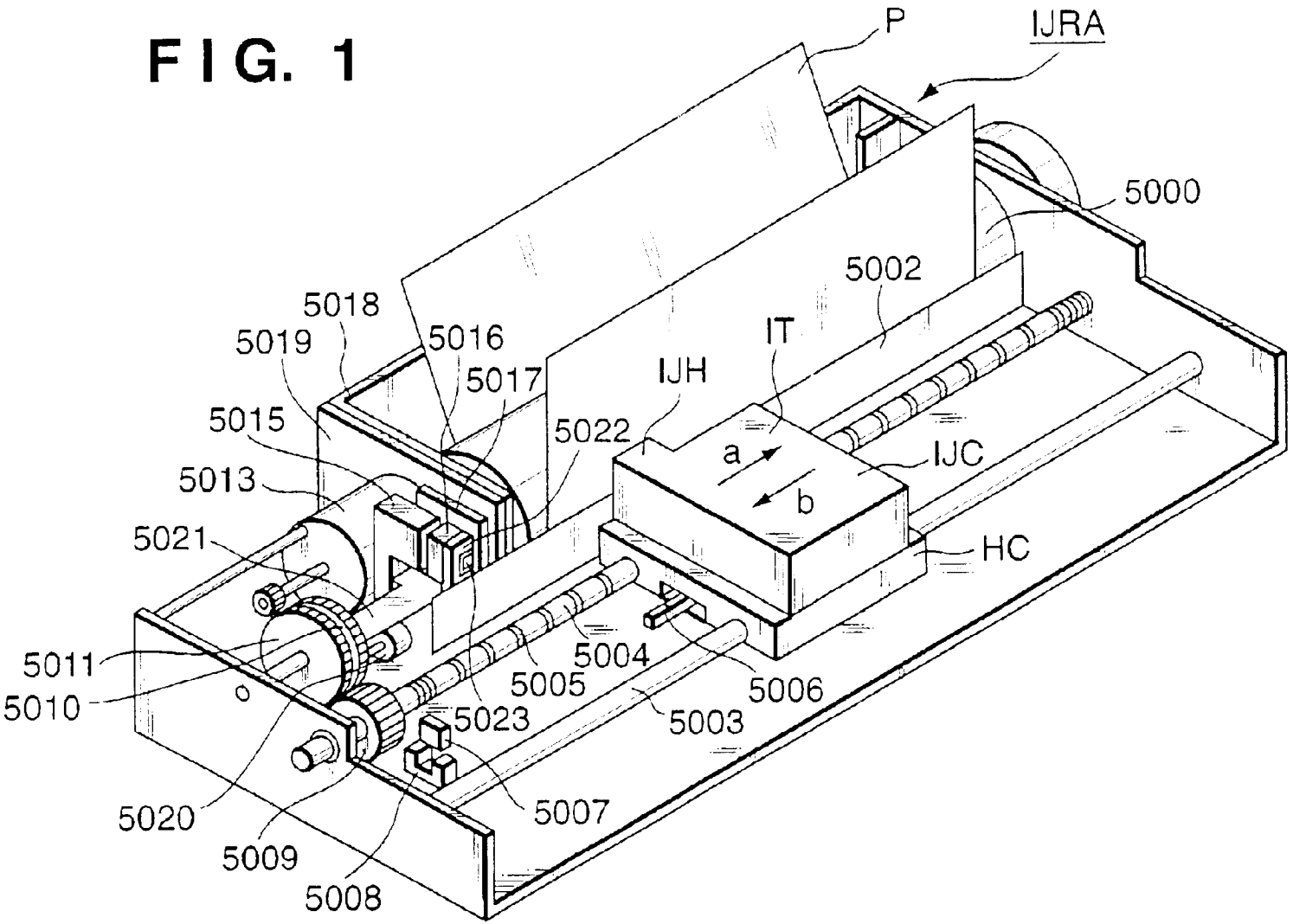
FIG. 1 is an oblique external view of a recording apparatus according to a first embodiment of the present invention.

FIG. 1 is an oblique external view of a recording apparatus according to a first embodiment of the present invention. In FIG. 1, a carriage HC that engages a spiral groove 5005 of a lead screw 5004 that rotates via drive transmission gears 5009–5011 linked to the forward and reverse rotation of the drive motors 5013 has a pin (not shown in the diagram), is supported by a guide rail 5003 and moves back and forth in directions indicated in the diagram by reference letters a and b. The carriage HC mounts an ink jet cartridge IJC that has both a built-in recording head IJH and a built-in ink tank IT.

Reference numeral 5002 is a pressing plate that presses a recording paper P against a platen 5000 along the direction in which the carriage HC moves. Reference numerals 5007 and 5008 denote photocouplers, which function as a home position detection unit by detecting the presence of a lever 5006 of the carriage HC in this vicinity and reversing the rotation of the motor 5013.

Reference numeral 5016 denotes a member that supports a cap member 5022 that caps a front surface of the recording head IJH, and 5015 denotes a suction unit for exerting suction on the interior of the cap so as to retract the recording head via an opening 5023 in the cap. Reference numeral 5017 is a cleaning blade and 5019 is a member that allows the cleaning blade 5017 to move back and forth, supported by a main support plate 5018. Those of ordinary skill in the art can appreciate that the cleaning blade 5017 may be any cleaning blade commonly used and widely known, and adapted to the present embodiment.

Additionally, reference numeral 5021 denotes a lever that commences suction for the suctional return, which moves with a cam 5020 that engages the carriage and is controlled by a commonly known drive mechanism such as a clutch switch and the like for controlling the drive force from the drive motor.

This capping, cleaning and suctional return are enabled by a construction in which the desired operation can be carried out at positions which correspond to these processes as appropriate, by the operation of the lead screw 5004 when the carriage has come to the home position. Provided these processes are carried out in any well-known sequence, any or all of these may be adapted to the present embodiment.

Next, a description will be given of a control configuration for executing recording control of the apparatus described above.

Figure 2:
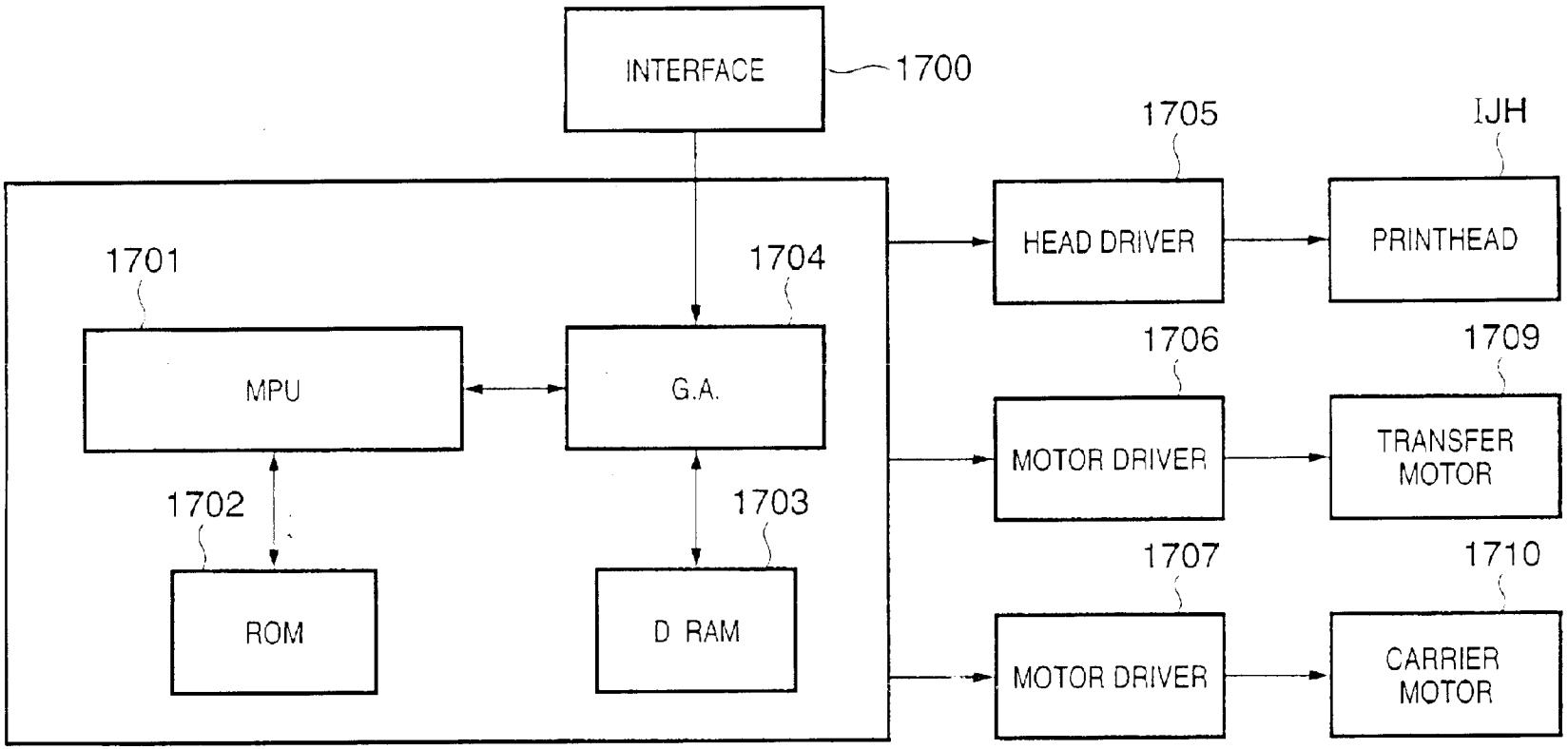
FIG. 2 is a block diagram of the control system of the recording apparatus of FIG. 1.

FIG. 2 is a block diagram of the control system of the recording apparatus of FIG. 1.

As shown in the diagram, reference numeral 1700 denotes an interface that inputs a recording signal, 1701 denotes an MPU, 1702 denotes a ROM containing a program that the MPU 1701 executes and 1703 is a DRAM that stores a wide variety of data, including the above-described recording signals and recording data supplied to the head. Reference numeral 1704 denotes a gate array that controls the supply of recording data to the recording head IJH, and controls the transfer of data among the interface 1700, the MPU 1701 and the RAM 1703. Reference numeral 1710 is a carrier motor for transporting the recording head IJH. Reference numeral 1709 is a transport motor for transporting the recording paper. Reference numeral 1705 is a head driver for driving the recording head, and 1706 and 1707 are motor drivers for driving the transfer motor 1709 and the carrier motor 1710, respectively.

When a recording signal is entered into the interface 1700, the recording signal is converted to print recording data between the gate array 1704 and the MPU 1701. Then, when the motor drivers 1706, 1707 are driven, the recording head is driven in accordance with the recording data sent from the head driver 1705 and recording performed.

It should be noted that, although in the above-described embodiment the control program executed by the MPU 1701 is stored in the ROM 1702, it is also possible to further add an erasable/writable recording medium such as an EEPROM and the like and to alter the control program from a host computer connected to the ink jet printer IJRA.

Those of ordinary skill in the art can appreciate that, as described above, the ink tank IT and the recording head IJH may be formed into a single unit as an interchangeable ink jet cartridge IJC. Of course, the ink tank IT and the recording head IJH may be detachable from each other, so that the ink tank IT can be replaced when the ink is depleted.

Figure 3:
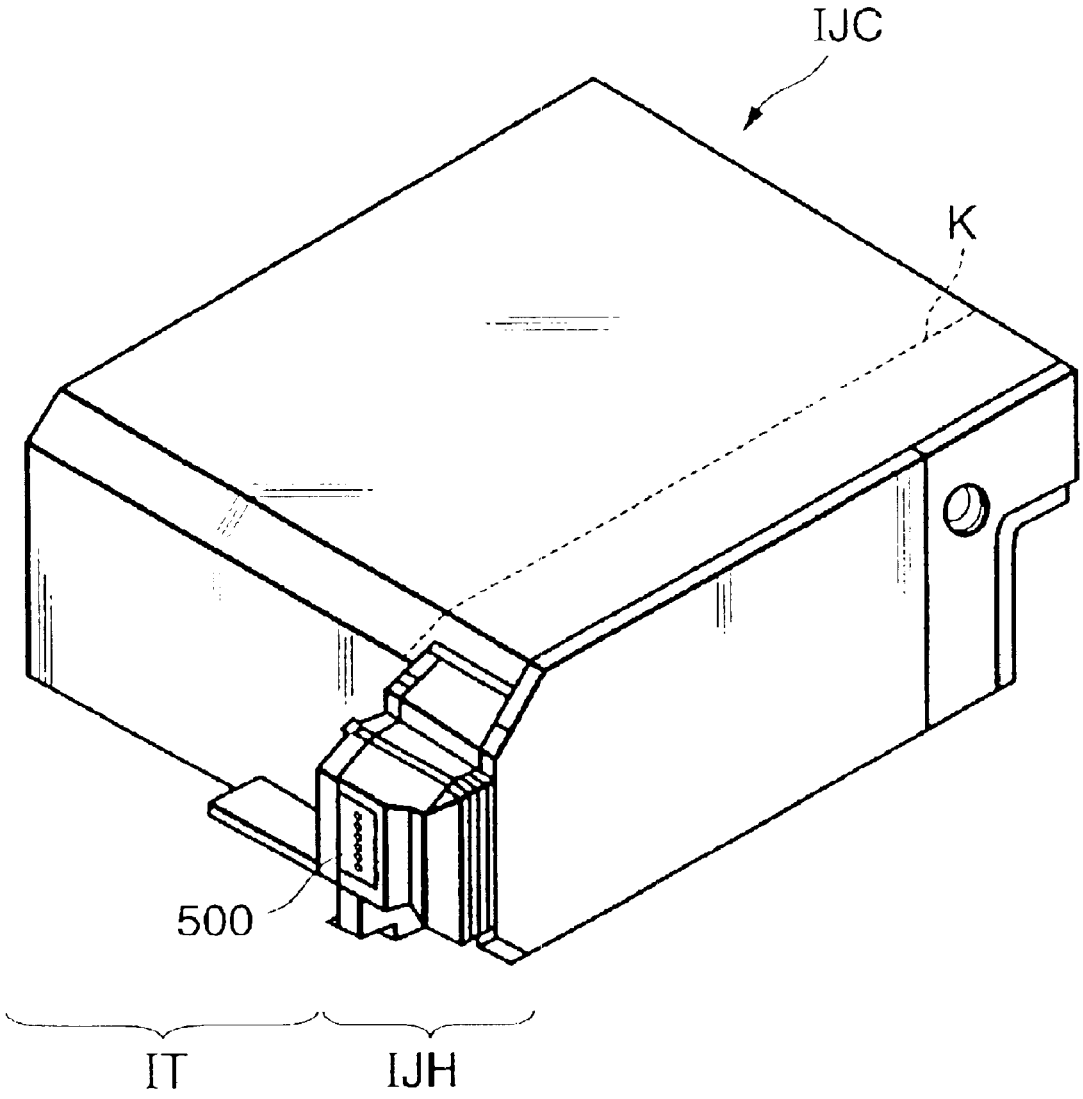
FIG. 3 is an oblique external view of an ink jet cartridge for the recording apparatus shown in FIG. 1.

FIG. 3 is an oblique external view of an ink jet cartridge for the recording apparatus shown in FIG. 1. It should be noted that, in FIG. 3, reference numeral 500 denotes a row of ink jet ejection ports. Additionally, the ink tank IT is provided with an ink absorber made of fibrous or porous material to hold the ink.

(First Embodiment)

A description is now given of an embodiment adapting the recording apparatus and the recording head drive method of the present invention, with reference to the accompanying drawings.

Figure 4:
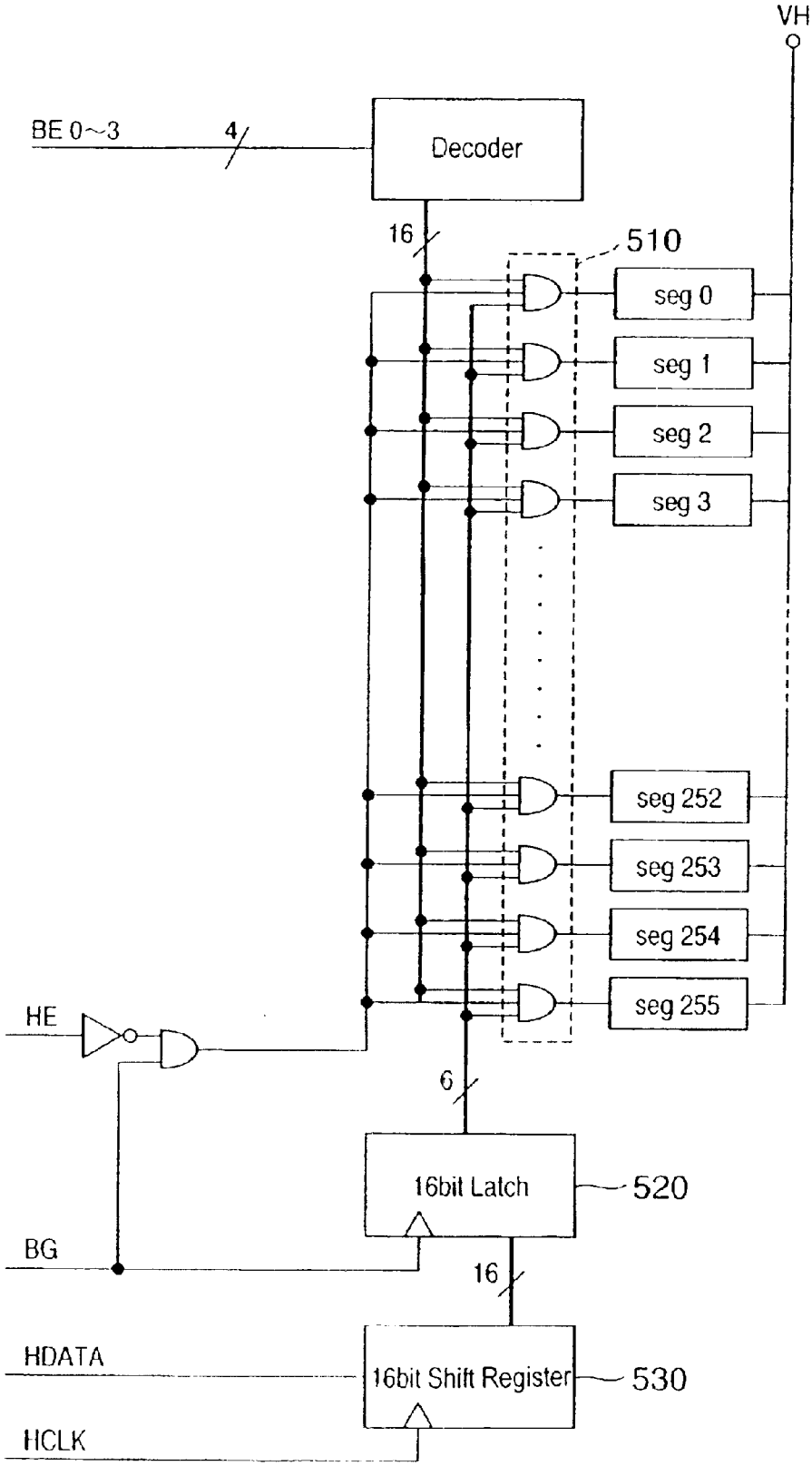
FIG. 4 is a block diagram showing a recording head drive circuit of a recording head mounted on a recording apparatus.

FIG. 4 is a block diagram showing a recording head drive circuit, which drives a recording head, disposed in the recording head mounted on the recording apparatus. As shown in the diagram, AND gate circuits 510 are paired with segments which include electrothermal energy conversion elements (segs 0 to 255) in order to eject ink. Block switching signals for driving block units of the electrothermal energy conversion elements included in the segments but not shown in the diagram, drive timing signals HE and recording data (HDATA) are input to the AND gate circuits 510.

Recording data of the same number of bits as the electrothermal energy conversion elements included in the segments is synchronized with a clock signal (HCLK), which is output from the head control circuit of the recording apparatus, that transfers recording data to the recording head and is transmitted in sequence to a recording data shift register 530 from the head control circuit of the recording apparatus. This process follows a timing chart like that shown in FIG. 5.

Figure 5:
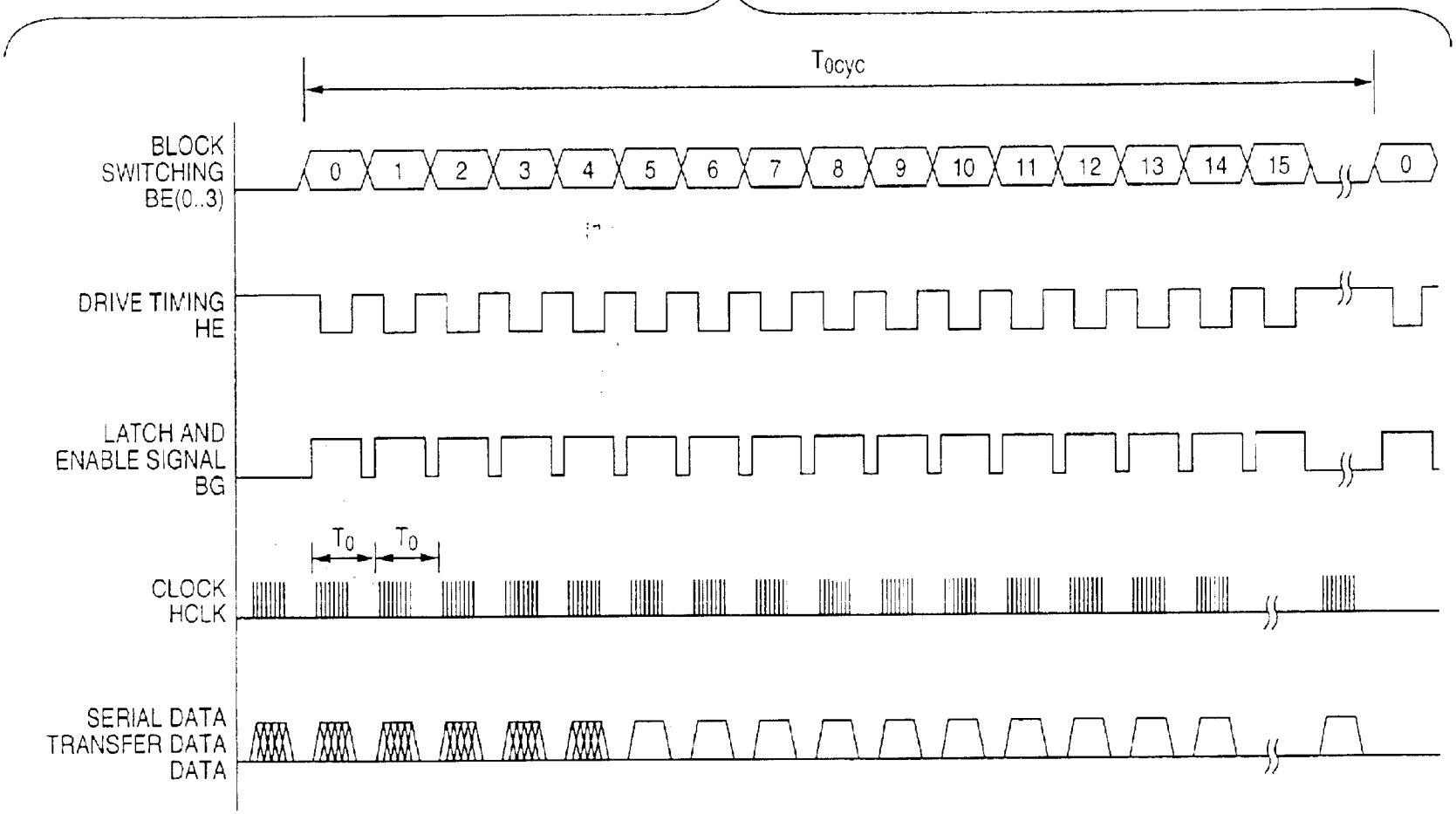
FIG. 5 is a drive timing chart for a recording head.

FIG. 5 is a drive timing chart for the recording head. The timing chart shown in FIG. 5 divides a 256-bit segment into 16 blocks and takes a block composed of a collection of segments as the recording head drive unit, with all 16 blocks being driven at a Cycle T0cyc.

After all the recording data (HDATA) is input into the shift register 530, a latch/enable signal (BG) is input from a head control circuit 1000 to head drive circuits 1010, 1020, 1030, 1040. The recording data is then read from the shift register 530 to a latch circuit 520.

Then, a block switching signal (BE) for driving the electrothermal energy conversion elements in sequential blocks is input to the head drive unit. The driving of the recording head is determined by the drive timing signal (HE), so that power is supplied to the electrothermal energy conversion elements of the selected block only when this signal is ON, with the effects of the bubbles generated by the resulting thermal energy causing the ink to be discharged from the ink ejection ports of the recording head.

The recording data latched at the latch circuit 520 is output to predetermined segments and recorded as the enable signal described above is input.

Figure 6:
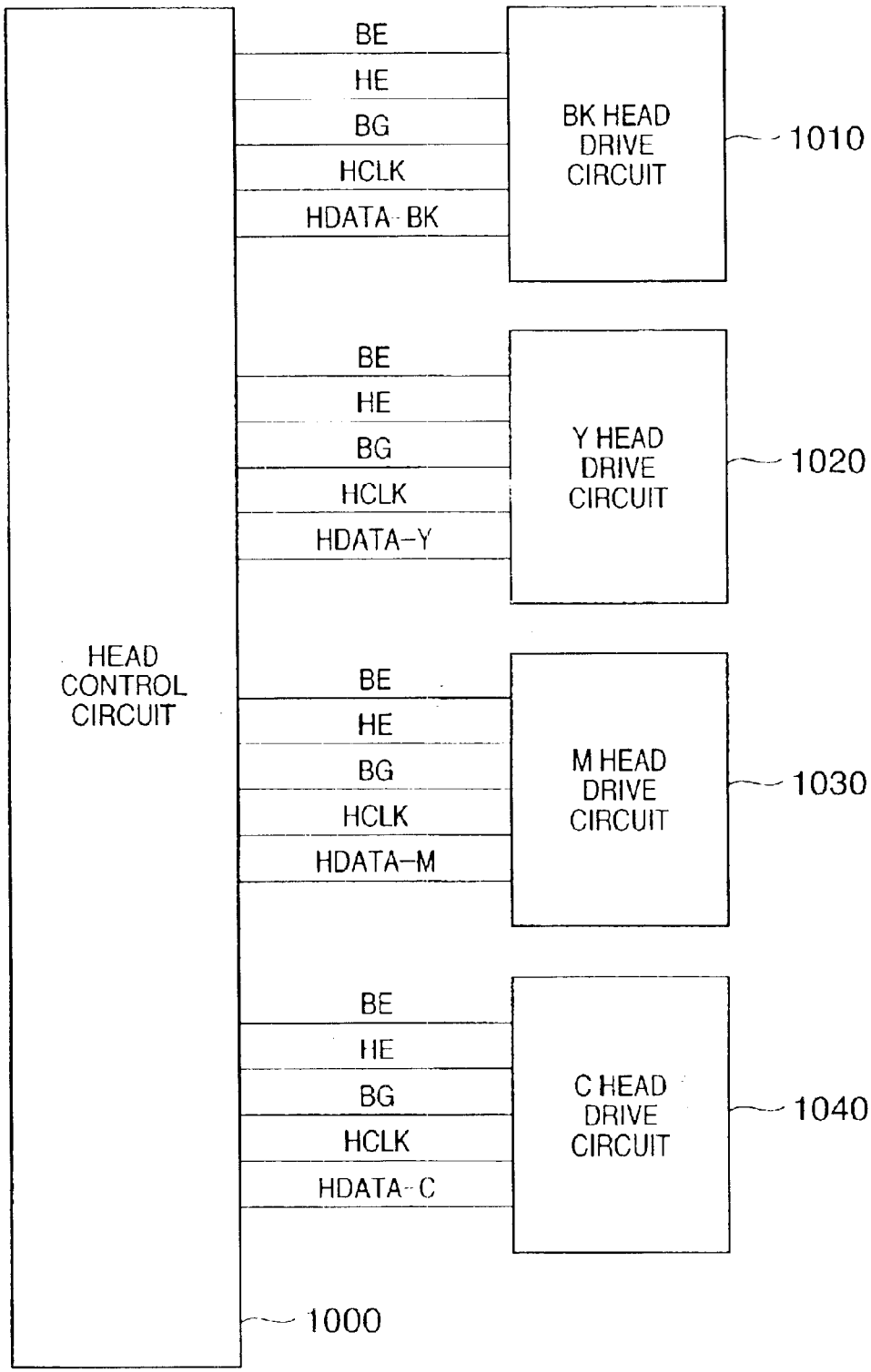
FIG. 6 is a diagram illustrating the connection between a head control circuit and the recording head drive circuits.

FIG. 6 is a diagram illustrating the connection between a head control circuit and the recording head drive circuits. In FIG. 6, reference numeral 1000 denotes the head control circuit. As shown in the diagram, the recording apparatus has either a single recording head or a plurality of recording heads (yellow (Y), magenta (M), cyan (C) and black (Bk)), and is capable of scanning the surface of, and recording thereon, a recording medium.

Figure 7:
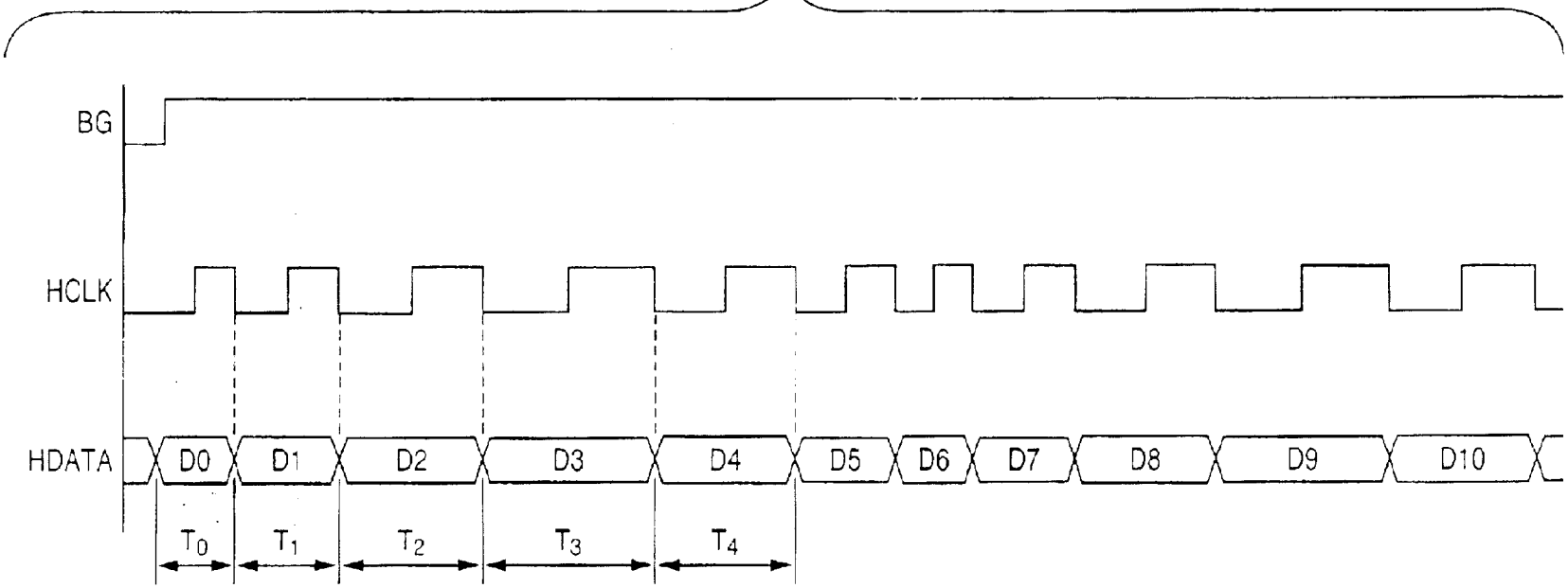
FIG. 7 is a diagram showing transmission clock and transmission data timing according to the first embodiment of the present invention.

FIG. 7 is a diagram showing transmission clock and transmission data timing according to the first embodiment of the present invention. The timing chart of FIG. 7 differs from the timing chart described with reference to FIG. 5 insofar as in FIG. 7, the clock cycle changes with each transfer of a data to the block to be driven. In other words, in the timing chart shown in FIG. 7, the clock frequency is controlled for each block data (here, D0, D1, D2, . . . ). In other words, different clock signals are set so that a clock cycle for transferring a first data D0 is T0 and a clock cycle for transferring a second data D0 is T1.

By controlling the transmission of data so that data is sent at eigen clock frequencies as shown in FIG. 5, although the radiation noise spectra might overlap when the target blocks are driven and the radiation peak level rises, it becomes possible to eliminate the problem of radiation noise peak overlay by changing the time interval as shown in FIG. 7 even when transmitting data in blocks.

Figure 8:
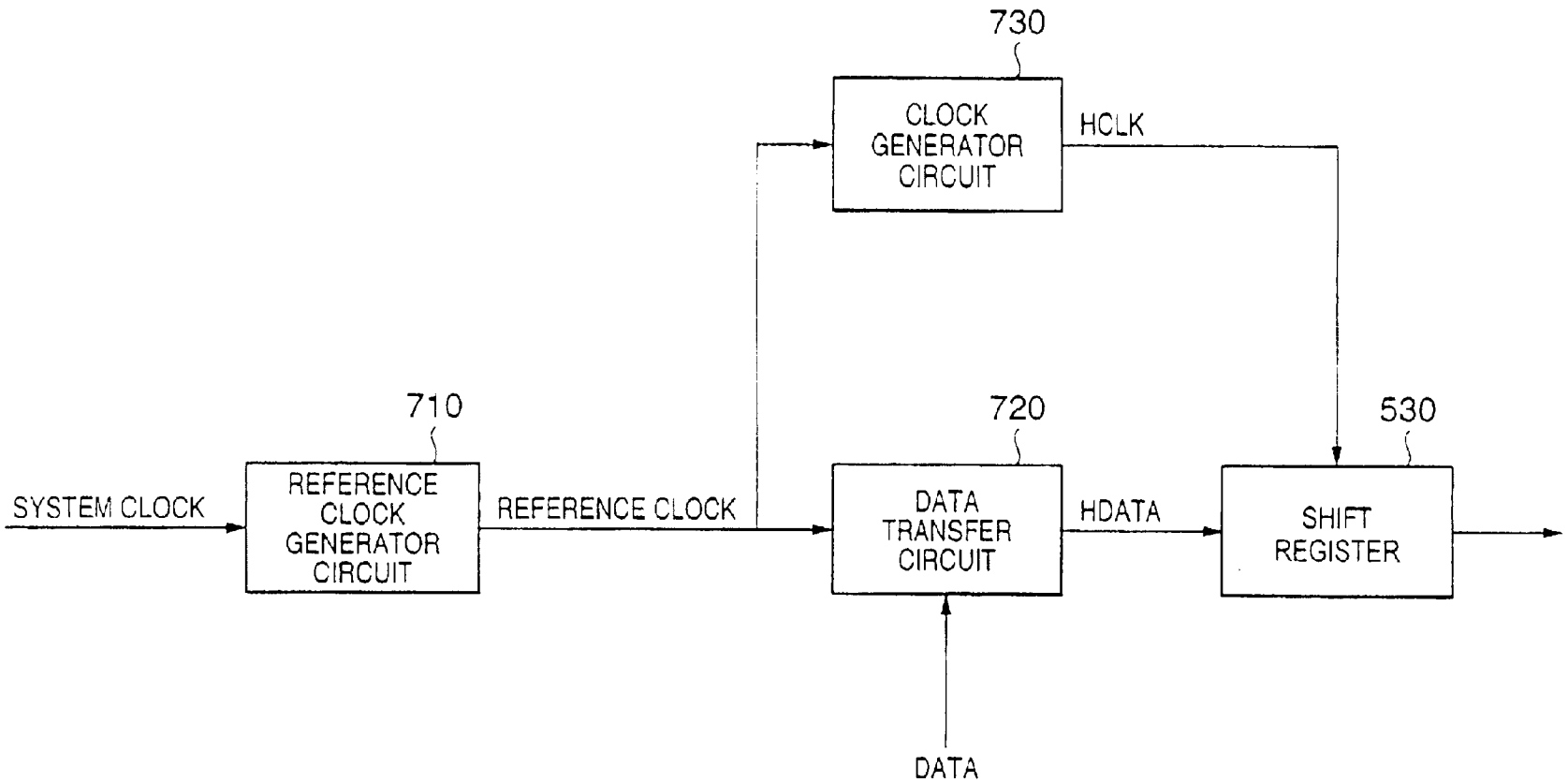
FIG. 8 is a diagram illustrating a block diagram for generating a variably controlled clock frequency.

FIG. 8 is a diagram illustrating a block diagram for generating a variably controlled clock frequency. As shown in the diagram, a reference clock generator circuit 710 receives a system clock signal from the recording apparatus main unit, and based on this signal the reference clock generator circuit 710 generates a reference clock signal that is input to a data transfer circuit 720 and a clock generator circuit 730. The clock generator circuit 730 then generates a variably controlled cycle signal HCLK according to the reference clock signal.

The data transfer circuit 720 forwards serial data transfer data (DATA) in the head control circuit 1000 to the shift register 530 as recording data (HDATA) according to the reference clock. According to the cycle-controlled signal HCLK, the shift register 530 then outputs the recording data (HDATA) to the latch circuit 520. The clock generator circuit 730 then updates the reference clock signal cycle each time the HCLK signal is sent so that the radiation noise spectra do not overlap. The changing of the reference clock cycle may be accomplished by adding a uniform time increment ΔT thereto, or the change may be accomplished by adding to the reference clock cycle a predetermined time increment (ΔT1, ΔT2 . . . ) previously stored in the ROM 1702 to each block data. Thus, for example, if the control cycle is ΔT, then the relation between a cycle T0 (data D0 transfer cycle) shown in the timing chart in FIG. 7 and a cycle T1 (data D1 transfer cycle) shown in the timing chart in FIG. 7 can be obtained by the following equation:

$$T1=T0+\Delta T \quad (1)$$

Similarly, the relation between a cycle T0 and a cycle T2 (data D2 transfer cycle) can be obtained by the following equation:

$$T2=T0+2\times\Delta T \quad (2)$$

In the same way as described above, the cycle for each block can be updated. This per-block variable cycle control is then reset to cycle T0 when driving of the 16th and final block is completed.

In addition, an eigen value to each block data may be used for the control cycle ΔT used to update the cycles in equations (1) and (2) described above. Thus, for example, if recording data (HDATA) D1, D2 transfer cycles T1, T2 are given eigen control cycles set at ΔT1 and ΔT2, respectively, then T1 and T2 can be obtained using the following equations:

$$T2=T0+2\times\Delta T \quad (3)$$

$$T2=T0+2\times\Delta T \quad (4)$$

By thus continuously changing the clock cycle as described above, it becomes possible to prevent radiation noise peaks from overlapping, which in turn weakens the strength of the electric field at certain cycles and makes it possible to reduce radiation noise levels.

(Second Embodiment)

As described above, the first embodiment of the present invention employs a variable clock cycle HCLK. However, with the recording apparatus according to a second embodiment of the present invention, the cycle of the clock signal HCLK is fixed while the transfer data transmission timing is variably controlled, that is, varied.

Figure 9:
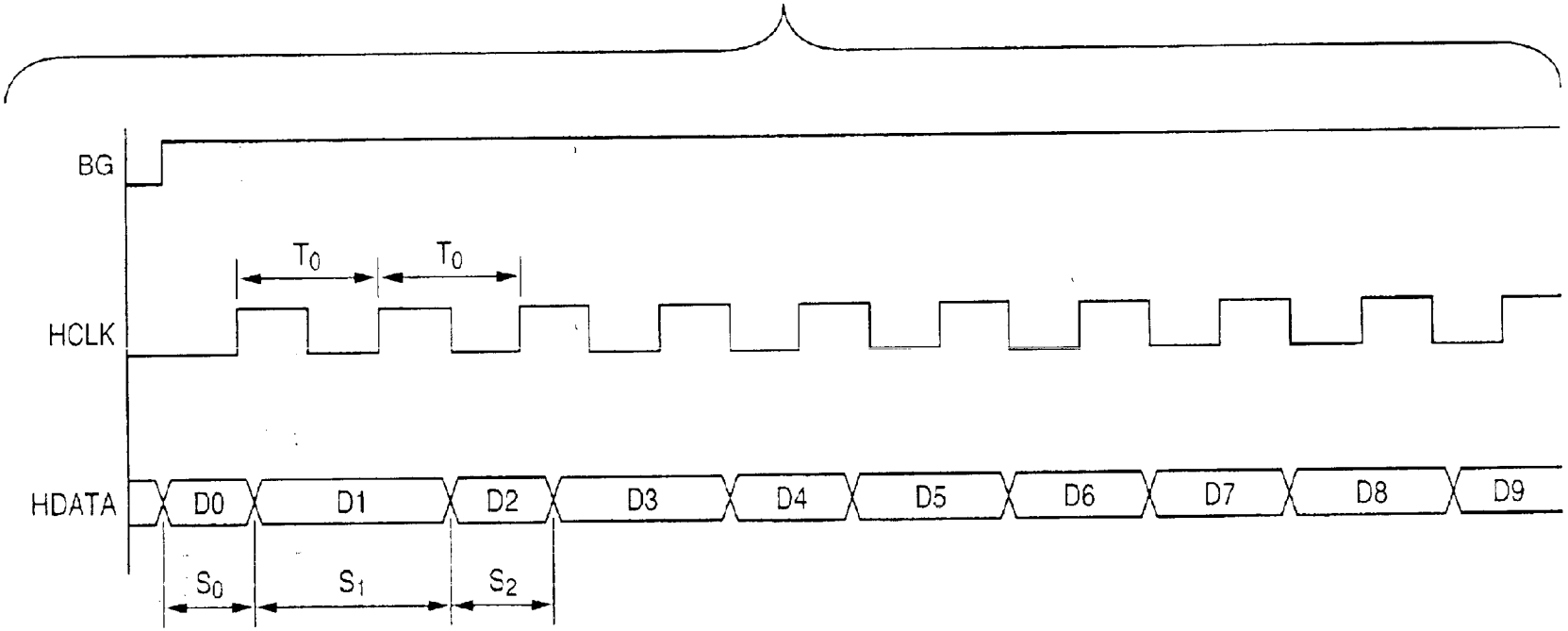
FIG. 9 shows transmission clock and transmission data timing according to a second embodiment of the present invention.

FIG. 9 shows transmission clock and transmission data timing according to a second embodiment of the present invention. The clock that the clock generator circuit 730 of FIG. 8 generates is fixed as a reference clock (cycle T0), and within the data transfer circuit 720 a setup/hold time (S0, S1, S2, . . . ) for controlling the transfer timing of data based on the reference clock is set to a different time for each block data, so that the data transfer cycle can be updated at every block.

By continuously updating the setup/hold time with each transfer of data as described above, radiation noise peaks can be prevented from overlapping, which in turn weakens the strength of the electric field at certain cycles and makes it possible to reduce radiation noise levels.

It should be noted that the object of the present invention may also be achieved by a combination of control of the setup/hold time as in the present embodiment and control of the clock cycle as in the first embodiment.

(Other Embodiments)

As shown in FIG. 4, by dividing a 256-bit segment into 16 blocks (each block having 16 segments) and driving in individual block units, an image of a segment row (or a segment column) can be recorded. As can be appreciated by those of ordinary skill in the art, although in the present embodiment the segments are divided into 16 blocks, the present invention is not limited to such a configuration and the object of the present invention can be achieved by other and different block divisions.

In a third embodiment of the present invention, to be described below, the data transfer clock cycle is controlled by column so as to prevent the radiation noise spectra from overlapping.

Figure 10:
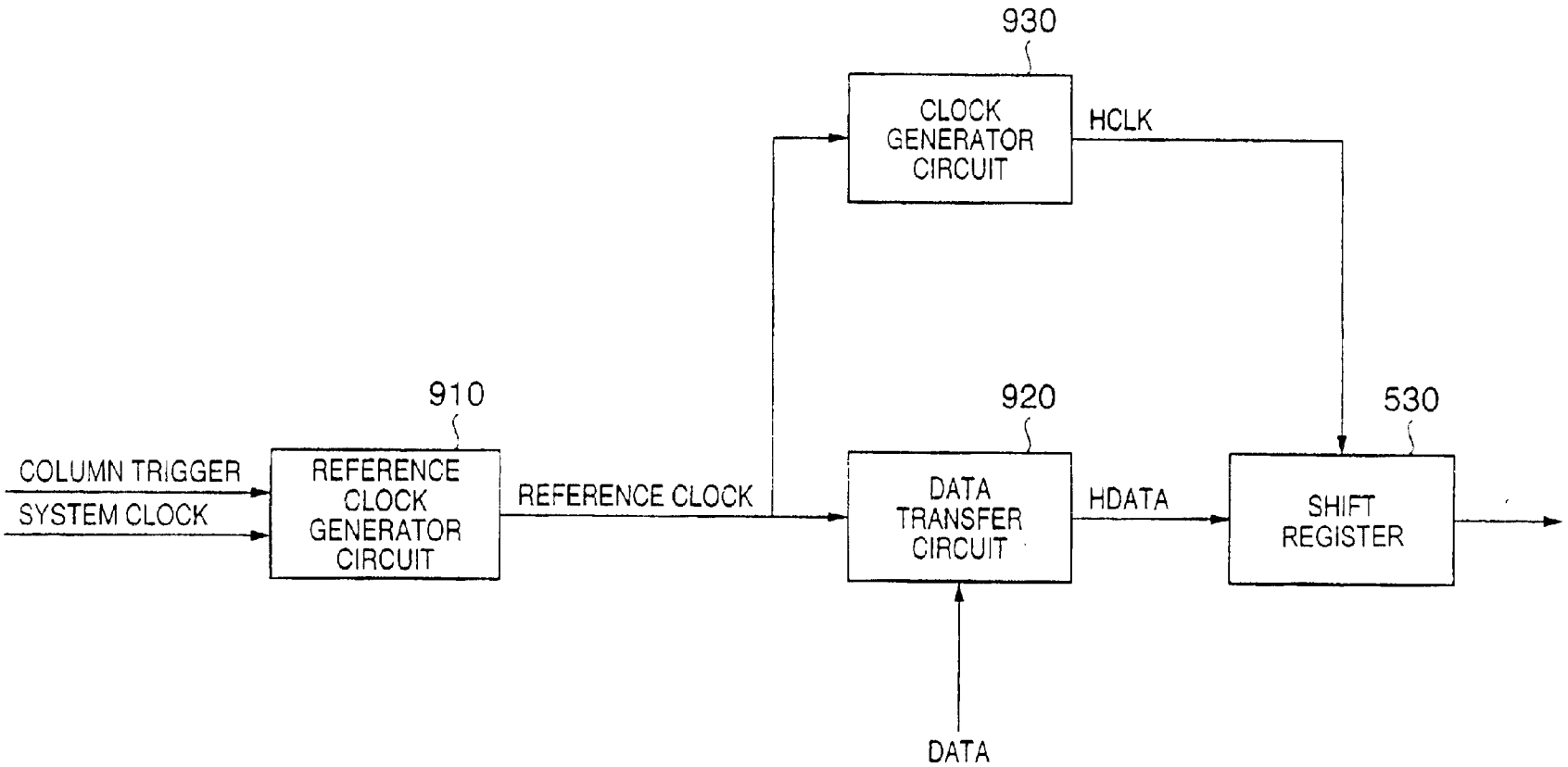
FIG. 10 is a diagram illustrating a block diagram for variably controlling a clock cycle on a per-column basis.

FIG. 10 is a diagram illustrating a block diagram for variably controlling a clock cycle on a per-column basis. The recording apparatus outputs a column trigger signal each time it drives a column. A reference clock generator circuit 910 receives the column trigger signal and a system clock signal and, based on these two signals, generates a column-unit-based reference clock signal which is input to a data transfer circuit 920 and to a clock generator circuit 930.

The clock generator circuit 930, according to the reference clock signal, generates a signal HCLK that varies the cycle in column units. In addition, the data transfer circuit 920 transfers serial data transfer data (DATA) in the head control circuit 1000 to the shift register as recording data (HDATA) according to the reference clock. The shift register 530 then outputs to a latch circuit the recording data (HDATA) according to the signal HCLK in which the cycle is varied in column units. As shown in FIG. 10, it becomes possible to variably control the clock generated at the reference clock generator circuit 930 each time a column trigger signal is input to the reference clock generator circuit 910, and hence it is possible to change the transfer clock cycle at each column. By so doing, it is possible to prevent the radiation noise peaks from overlapping, which in turn weakens the strength of the electric field at certain cycles and makes it possible to reduce radiation noise levels.

It should be noted that the object of the present invention may also be achieved by a combination of column-unit-based data transfer cycle control, on the one hand, and either the control of the setup/hold time as in the second embodiment or the control of the clock cycle as in the first embodiment as described above, on the other.

In addition, as can be appreciated by those of ordinary skill in the art, the data transfer cycle variable control described above with reference to the first, second and third embodiments can be adapted to the recording head or each of a plurality of recording heads corresponding to a plurality of colors (i.e., yellow (Y), magenta (M), cyan (C) and black (Bk)), with even greater suppression of generated radiation noise levels.

It should be noted that, in the above-described embodiment, it is assumed that the drops of fluid discharged from the recording head or recording heads are ink, and that the fluid contained in the ink tank is also ink. However, the present invention is not limited to the use of ink. Thus, for example, in order to provide the recording image with enhanced adhesion and waterproof properties, or to improve the quality of the image, a processing fluid that is discharged onto the storage medium may be contained in the ink tank.

The above-described embodiments, particularly when used in ink jet recording systems, are capable of achieving high-density, highly detailed recordings by using a scheme in which a thermal energy-generating means (such as, for example, an electrothermal transducer) for providing the energy used to discharge the ink is used to cause changes in the state of the ink.

The present invention provides outstanding effects with a print head and recording apparatus of the ink-jet recording type, especially of the kind that utilizes thermal energy.

As the typical arrangement and principle of the ink-jet printing system, one practiced by use of the basic principle disclosed in, for example, U.S. Pat. Nos. 4,723,129 and 4,740,796 is preferable. The above system is applicable to either one of a so-called on-demand type or continuous type. Particularly, in the case of the on-demand type, the system is effective because, by applying at least one driving signal, which corresponds to printing information and gives a rapid temperature rise exceeding nucleate boiling, to each of electrothermal transducers arranged in correspondence with a sheet or liquid channels holding a liquid (ink), heat energy is generated by the electrothermal transducer to effect film boiling on the heat acting surface of the print head, and consequently, a bubble can be formed in the liquid (ink) in one-to-one correspondence with the driving signal.

By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the print head, in addition to the arrangement as a combination of discharge nozzles, liquid channels, and electrothermal transducers (linear liquid channels or right angle liquid channels) as disclosed in the above patents, the arrangement using U.S. Pat. Nos. 4,558,333 and 4,459,600, which disclose the arrangement having a heat acting portion arranged in a flexed region, is also included in the present invention.

Furthermore, as a full line type print head having a length corresponding to the width of a maximum printing medium which can be printed by the printer, either the arrangement which satisfies the full-line length by combining a plurality of print heads as disclosed in the above specification or the arrangement as a single print head obtained by forming print heads integrally can be used.

In addition, not only an exchangeable chip type print head, as described in the above embodiment, which can be electrically connected to the apparatus main unit and can receive ink from the apparatus main unit upon being mounted on the apparatus main unit, but also a cartridge type print head, in which an ink tank is integrally arranged on the print head itself, can be applicable to the present invention.

It is preferable to add recovery means for the print head, preliminary auxiliary means, and the like provided as an arrangement of the printer of the present invention since the printing operation can be further stabilized. Examples of such means include, for the print head, capping means, cleaning means, pressurization or suction means, and preliminary heating means using electrothermal transducers, another heating element, or a combination thereof. It is also effective for stable printing to provide a preliminary discharge mode which performs discharge independently of printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated print head or by combining a plurality of print heads.

The present invention can be applied to a system constituted by a plurality of devices (e.g., host computer, interface, reader, printer) or to an apparatus comprising a single device (e.g., copying machine, facsimile machine).

As described above, by varying the data transfer cycle of data to the recording head, the recording apparatus of the present invention makes it possible to suppress a rise in radiation noise peak levels due to overlapping of radiation noise spectra, which in turn weakens the strength of the electric field at certain cycles and makes it possible to reduce radiation noise levels.

As many apparently widely different embodiments of the present invention can be made without departing from the spirit and scope thereof, it is to be understood that the invention is not limited to the specific preferred embodiments described above except as defined in the claims.

What is claimed is:

1. A recording apparatus having a recording head and which performs recording on a recording medium based on information transmitted by an external apparatus, the recording apparatus comprising:

a cycle control unit adapted to variably control a transmission cycle, when transmitting recording data to the recording head; and a head control unit adapted to control the recording head based on the controlled transmission cycle and the recording data, wherein said cycle control unit generates a transmission cycle combining eigen transmission cycles to each block and eigen transmission cycles to each column, and wherein said head control unit controls the recording data according to the combined transmission cycle.

2. The recording apparatus of claim 1, wherein said cycle control unit generates a different transmission cycle for each of a plurality of recording heads; and wherein said head control unit controls the recording data according to the different transmission cycles generated for each of the plurality of recording heads.

3. The recording apparatus of claim 1, wherein the recording head is an ink jet recording head that records by ejecting ink.

4. The recording apparatus of claim 1, wherein the recording head uses thermal energy to eject ink and is equipped with a thermal energy converter for generating thermal energy to be imparted to the ink.

* * * * *

UNITED STATES PATENT AND TRADEMARK OFFICE

CERTIFICATE OF CORRECTION

PATENT NO. : 6,824,235 B2
DATED : November 30, 2004
INVENTOR(S) : Takayuki Murata It is certified that error appears in the above-identified patent and that said Letters Patent is hereby corrected as shown below:

Column 10,
Line 3, “heads;” should read -- heads, --.

Signed and Sealed this

Twenty-fourth Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,824,235 B2
DATED : November 30, 2004
INVENTOR(S) : Takayuki Murata It is certified that error appears in the above-identified patent and that said Letters Patent is hereby corrected as shown below:

Column 10,
Line 3, "heads;" should read -- heads, --.

Signed and Sealed this

Fourteenth Day of June, 2005

JON W. DUDAS
*Director of the United States Patent and Trademark Office*